United States Patent [19]

Imanishi et al.

[11] Patent Number: 4,651,866

[45] Date of Patent: Mar. 24, 1987

[54] FEED BAR DRIVING SYSTEM IN TRANSFER PRESS MACHINE

[75] Inventors: Syozo Imanishi; Hiroyoshi Yamakawa; Yutaka Ono, all of Sagamihara, Japan

[73] Assignee: Aida Engineering, Ltd., Sagamihara, Japan

[21] Appl. No.: 817,051

[22] Filed: Jan. 8, 1986

[30] Foreign Application Priority Data

| | | | |
|---|---|---|---|
| Jan. 17, 1985 | [JP] | Japan | 60-4648[U] |
| Apr. 26, 1985 | [JP] | Japan | 60-62962[U] |
| May 10, 1985 | [JP] | Japan | 60-69215[U] |
| May 10, 1985 | [JP] | Japan | 60-69208[U] |
| Dec. 6, 1985 | [JP] | Japan | 60-274593 |

[51] Int. Cl.[4] ..... B65G 45/02

[52] U.S. Cl. ..... 198/500; 198/621; 72/405; 72/41

[58] Field of Search ..... 198/621, 751, 774, 500; 72/405, 421, 422, 41, 43; 414/749–751

[56] References Cited

U.S. PATENT DOCUMENTS

| | | | |
|---|---|---|---|
| 3,760,957 | 9/1973 | Berger | 198/621 |
| 4,393,682 | 7/1983 | Imanishi | 198/621 |

FOREIGN PATENT DOCUMENTS

| | | | |
|---|---|---|---|
| 620789 | 5/1961 | Italy | 72/405 |

*Primary Examiner*—Joseph E. Valenza

*Attorney, Agent, or Firm*—Sandler & Greenblum

[57] ABSTRACT

A system for tridimensionally driving feed bars in a transfer press machine. This system includes an advance-return device for causing the fed bars to advance or return, a device for approaching the feed bars to each other or separating the feed bars from each other to thereby clamp or unclamp a work, and a lift-lowering device for raising or lowering the feed bars. Members for holding the feed bars are approached to each other or separated from each other by the rotation of two pinions, these two pinions are rotated by a rack connected to a crankshaft through a connecting mechanism including a lever. The left-lowering device is constructed such that a pinion in engagement with a spline shaft and a rack in engagement with this pinion to be vertically movable are provided in operational association with the feed bar holding members. The spline shaft is driven by the same driving source as that for the clamp-unclamp device.

16 Claims, 18 Drawing Figures

FEED BAR DRIVING SYSTEM IN TRANSFER PRESS MACHINE

BACKGROUND OF THE INVENTION

1. Field of the Invention

This invention relates to a feed bar driving system in a transfer press machine, and more particularly to improvements in a system for moving feed bars.

2. Description of the Prior Art

Feed bars in a transfer press machine are tridimensionally moved by advance-return motions performed in the order of advance, stop, return and stop, motions of approaching the feed bars to each other to clamp a work or separating the feed bars from each other to unclamp the work and motions of lifting or lowering the feed bars when the work is carried in or out from a molding position. These motions are realized by an advance-return device, a clamp-unclamp device and a lift-lowering device, respectively.

Out of the above mentioned devices, as the advance-return device, a device, wherein a planetary gear mechanism and a crank mechanism are combined to each other, or a cam type device have heretofore been used. However, there have been such disadvantages that the former is complicated in mechanism, and moreover, vibrations due to backlashes of gears tend to be generated, and the latter is troublesome in manufacturing a cam.

The conventional clamp-unclamp device is constituted by a cam mechanism, a plurality of gear mechanisms and the like, and these cam mechanism, the gear mechanisms and the like are adapted to transmit a driving force through contacts between the members.

In consequence, each of the conventional devices is provided with a multiplicity of portions where the members are brought into contact with each other to transmit the driving force, whereby, while the driving force inputted from a cam member connected to a driving shaft of a slide is passed through a driving force transmission route constituted by the cam mechanism, gear mechanism and the like and transmitted to a member for holding the feed bars, a time lag occurs due to backlash between the aforesaid members, thus presenting such a disadvantage that the device as a whole is low in operating efficiency. Because of this, if the vertically moving speed of the slide is increased in order to improve the press operating efficiency, then the approaching-separating operations of the feed bars cannot follow the vertical movement of the slide, thus presenting the disadvantage of that the vertically moving speed of the slide cannot be highly increased.

SUMMARY OF THE INVENTION

The present invention has as its object the provision of a feed bar driving system in a transfer press, wherein a driving force can be rapidly transmitted to feed bars while vibrations due to backlashes and the like are being prevented, the vertically moving speed of a slide can be highly increased with satisfactory operating efficiency, and the feed bar driving system can be generally formed to be compact in size.

To this end, the present invention contemplates that, in a feed bar driving system in a transfer press machine, wherein two feed bars being in parallel to each other are driven, a work carried in by these feed bars is formed into a predetermined shape and carried out, the feed bar driving system comprises: an advance-return device for reciprocating the feed bars each having work clamping fingers, for a predetermined distance in the longitudinal direction of the feed bars; and a clamp-unclamp device for approaching the feed bars to each other or separating the feed bars from each other in a state of where the feed bars are in parallel to each other so that the fingers can clamp or unclamp the work, the clamp-unclamp device including an eccentric member affixed to a crankshaft rotatable in synchronism with the vertical movement of a slide, connecting means one end of which is connected to this eccentric member, a lever member connected to the other end of this connecting means, a rack connected to this lever member and linearly, reciprocatingly movably supported, two pinions being in engagement with this rack, and feed bar holding members connected to eccentric members affixed to these pinions, the feed bars movable in a direction of approaching to each other or being separated from each other by the rotation of the eccentric members.

DETAILED DESCRIPTION OF THE PREFERRED EMBODIMENT

Description will hereunder be given of one embodiment of the present invention with reference to the drawings.

Figure 1:
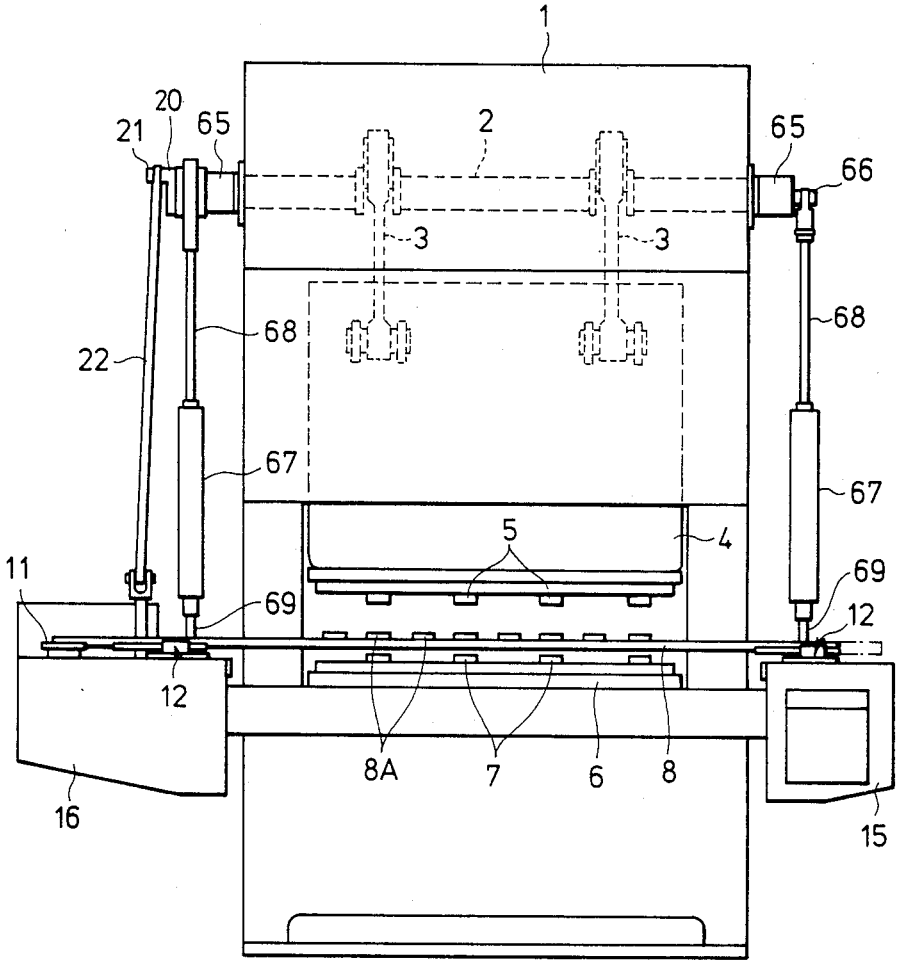
FIG. 1 is a front view showing the general arrangement of the transfer press machine.
Figure 2:
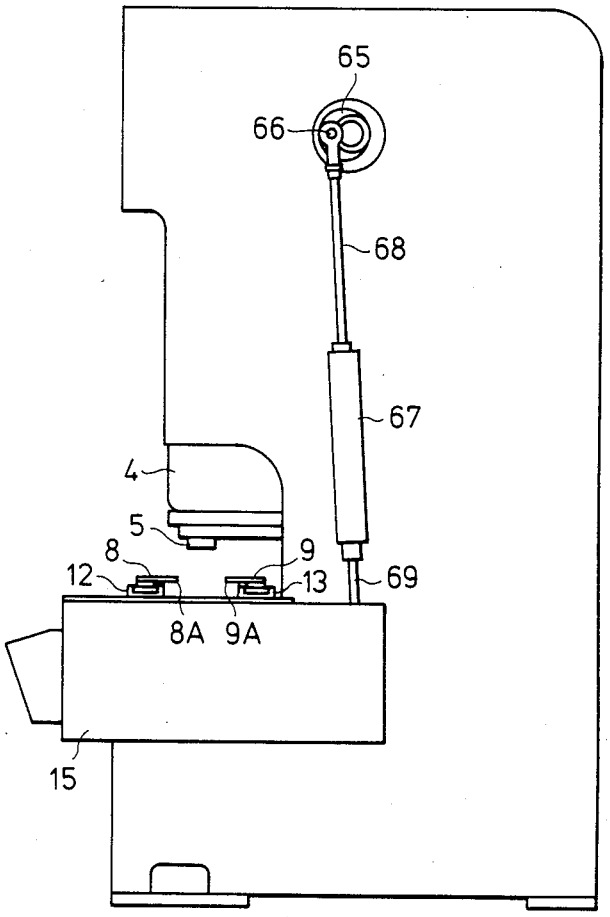
FIG. 2 is a right side view.

FIG. 1 is the front view showing the transfer press machine in this embodiment, and FIG. 2 is the right side view thereof. In these drawings, a crankshaft 2 is transversely racked across the interior of a crown 1, and a slide 4 is connected to this crankshaft 2 through a connecting rods 3. A driving force is transmitted from a motor, not shown, to the crankshaft 2 to rotate the same, whereby this slide 4 is vertically moved. Top forces 5 are secured to the bottom portion of the slide 4. As the slider 4 is lowered, a work is pressed by this top forces 5 and bottom forces 7 secured to the top portion of a bolster 6. Two feed bars 8 and 9 being in parallel to each other are fixedly supported by feed bar moving blocks 10 and 11 movably provided in the clamp-unclamp direction (Refer to FIG. 3) at the left end in FIG. 1, whereby, as the feed bar moving blocks 10 and 11 advance or return, the feed bars 8 and 9 advance or return. The feed bars 8 and 9 are horizontally supported by feed bar holding members 12 and 13 in such a manner that the feed bars are moved in the advance return direction and not moved in the clamp-unclamp direction, respectively, at portions of the feed bars 8 and 9 inwardly of these feed bar moving blocks 10 and 11 and at portions of the feed bars 8 and 9 close to the right ends thereof in FIG. 1, and, as these holding members 12 and 13 approach to each other, are separated from other, ascend and descend, the feed bars 8 and 9 also approach to each other, are separated from each other, ascend and descend. In this case, as the feed bars 8 and 9 approach to each other or are separated from each other, fingers 8A and 9A provided on the feed bars 8 and 9, respectively, clamp or unclamp the work.

The above-described operations of the feed bars 8 and 9, the feed bar moving blocks 10 and 11 and the feed bar holding members 12 and 13 are carried out by the devices including the advance-return device, the clamp-unclamp device and the lift-lowering device, all of which are housed in right and left control boxes 15 and 16 of the press machine.

The advance-return device is adapted to move the feed bars 8 and 9 in directions of advance and return and this device is housed in the control box 16.

Figure 3:
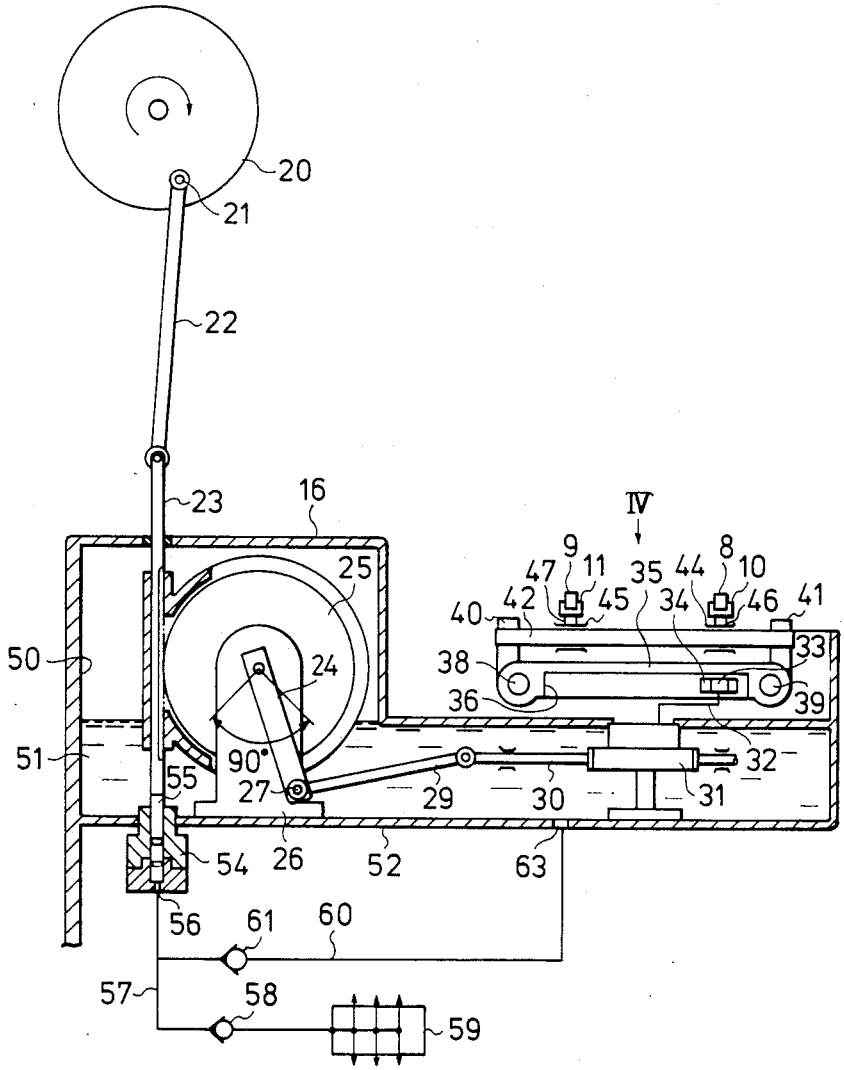
FIG. 3 is a partially sectional view showing the advance-return device of the feed bars.
Figure 4:
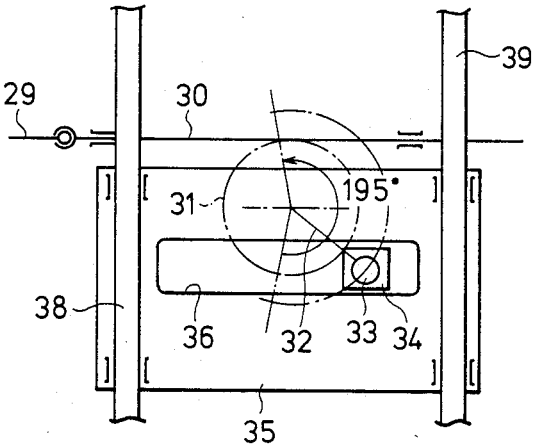
FIG. 4 is a plan view as viewed from an arrow IV in FIG. 3.

FIGS. 3 and 4 show the advance-return device. Referring to these drawings, an eccentric pin 21 is affixed to an eccentric member 20 fixed to one end of the crankshaft 2, and the top end of a rack 23 is connected to this eccentric pin 21 through a rod member 22. This rack 23 is vertically slidable in the control box 16. In this embodiment, the axis of the eccentric member 20 is positioned on an extension of the rack 23. A first pinion 25 being in engagement with the rack 23 is rotatably provided through a bearing 26. This first pinion 25 is provided at the rotary axis thereof with an arm 24 on which an eccentric pin 27 driven in unison with the first pinion 25 due to the vertical movement of the rack 23, so that the eccentric pin 27 can reciprocatingly rotate within equal angular scopes to opposite sides from a position directly beneath the axis of the first pinion 25, the angle being 90° totally. This angle is adjusted such that the value of eccentricity of the first eccentric pin 21 to thereby change the stroke of the rack 23, or the diameter of the first pinion 25 is changed.

One end of a connecting rod 29 is connected to the second eccentric pin 27 and the other end is connected to one end of a rack 30 supported in a manner to be movable in a horizontal direction perpendicularly intersecting the directions of advance and return of the feed bars 8 and 9. This rack 30 is in engagement with a second pinion 31 rotatably provided and the axis of which is directed vertically, a third eccentric pin 33 is provided on a lever 32 affixed to a shaft of this second pinion 31, onto which is rotatably fitted a runner 34. This third eccentric pin 33 is driven about the shaft of the second pinion 31 in unison therewith due to the reciprocatory movement of the rack 30, and can reciprocatingly rotate within equal angular scopes to opposite sides from the center of the second pinion 31, incorporated in the direction perpendicularly intersecting the advance and return directions of the feed bars 8 and 9, the angle being 195 totally (Refer to FIG. 4). This angle is adjustable such that the eccentric values of the first and the second eccentric pins 21 and 27 are changed or the diameters of the first and the second pinions 25 and 31 are varied.

The runner 34 is inserted into a groove 36 formed on the undersurface of a slider 35 in the direction perpendicularly intersecting the directions of the advance and return, and the slider 35 is slidably guided by guide rods 38 and 39 being provided in parallel to the directions of the advance and return. Columns 40 and 41 are erected from the top surface of the slider 35. Transversely racked across the columns 40, 41 is a bar 42 movable together with the slider 35, and coupled to this bar 42 are movable blocks 44 and 45. Vertically movably inserted into the movable blocks 44 and 45 are support rods 46 and 47 provided on the undersurfaces of the feed bar moving blocks 10 and 11. With this arrangement, along with the rotation of the eccentric pin 33, the runner 34 slides in the groove 36 to reciprocate the slider 35 in the directions of the advance and return, so that the feed bars 8 and 9 can advance or return.

Description will hereunder be given of an initial condition in the general case of the mechanisms in the advance-return device.

Figure 5:
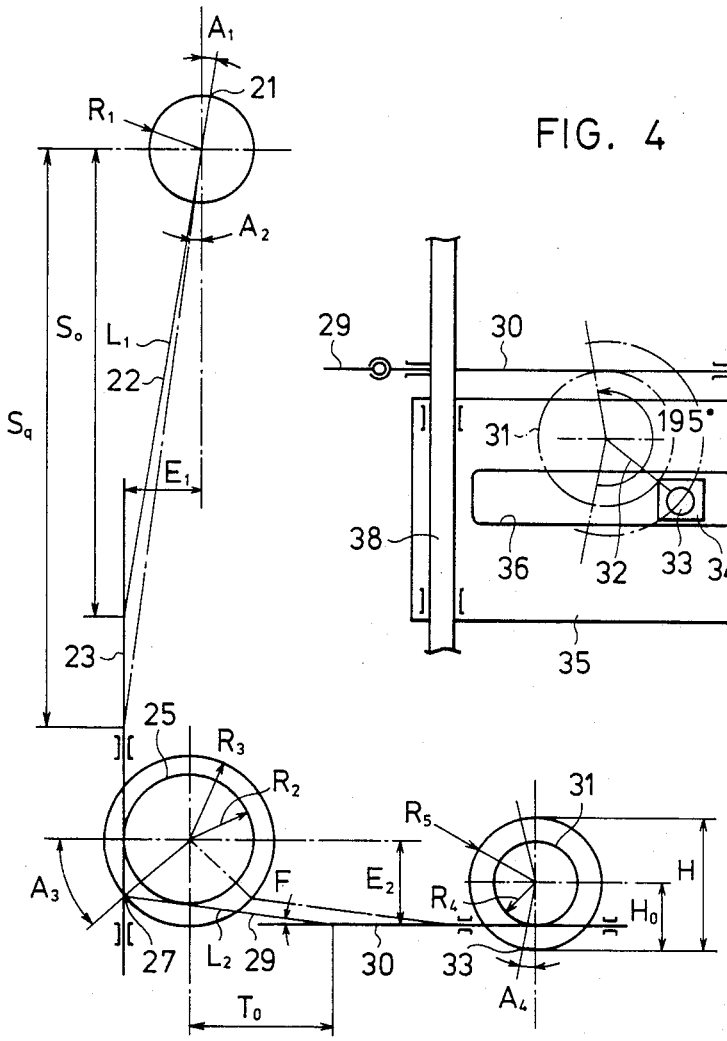
FIG. 5 is an explanatory view for calculating the characteristics of the motions of various portions of the advance-return device.

In FIG. 5, if the values of eccentricity of the first to the third eccentric pins 21, 27 and 33 are $R_1$, $R_3$ and $R_5$; the pitch radii of the first and the second pinions 25 and 31 are $R_2$ and $R_4$; the lengths of the connecting rods 22 and 29 are $L_1$ and $L_2$; and the distance between the rotary center of the first eccentric pin 21 and the rack 23 is $E_1$ and the distance between the rotary center of the second eccentric pin 27 and the rack 30 is $E_2$, then, when the rack 23 is positioned at the upper limit or the lower limit, angles $A_1$ and $A_2$ with the position of the first eccentric pin 21 and the distances $S_0$ and $S_9$ from the rotary center of the eccentric pin 21 to the other end of the connecting rod 22 will be represented by the following equations $$S_0=(L_1-R_1)\cdot\cos A_1$$

$$S_9=(L_1+R_1)\cdot\cos A_z$$

$$A_1=\sin^{-1}E_1/(L_1-R_1)$$

$$A_z=\sin^{-1}E_1/(L_1+R_1)$$

When the rack 30 is positioned at the left end of its stroke, an angle $A_3$ at the position of the second eccentric pin 27, an angle F made between the connecting rod 29 and the rack 30 then, an angle $A_4$ at the position of the third eccentric pin 33 and a distance $H_0$ between the eccentric pin 33 and the rotary center of the eccentric pin 33 then will be represented by the following equations.

$$H_0=-R_5\cdot\cos A_4$$

$$A_3=\{\pi-(S_9-S_0)/R_2\}/2$$

$$F=sin^{-1}\{(E_2-R_3\cdot\sin A_3)\}/L_2$$

$$T_0=L_2\cdot\cos F-R_3\cdot\cos A_3$$

$$A_4=\{\pi-(2\times R_3\cdot\cos A_3)/R_4\}/2$$

Additionally, a portion of the interior of the control box 16 is an oil tank 50, which is filled up with oil 51. Provided at a position coaxial with the rack 23 on a bottom wall portion 52 of the oil tank 50 is a cylinder 54, into which is inserted a piston 55 formed on the bottom end of the rack 23.

Connected to a discharge port 56 of the cylinder 54 is an oiling circuit 57. This oiling circuit 57 is provided with a check valve 58 normally operative at 0.4 $Kg/cm^2$ to open and a distributing valve 59 for connecting branch circuits to required portions. The oiling circuit 57 is provided with a bypass circuit 60 between the oil tank 50 and itself, having a large pipe diameter, for rapidly relieving oil when anything unusual occurs somewhere in the oiling circuit 57 and oil pressure is raised. The bypass circuit 60 is provided with a check valve 61 operative at high discharge pressure, e.g. 4.5 $Kg/cm^2$, and also provided with a return port 63 for connecting the bypass circuit 60 to the bottom wall portion 52 of the oil tank 50. Due to the presence of this oiling circuit 57, when the rack 23 is moved and the piston 55 is inserted into the cylinder 54, the oil 51 filled in the oil tank 50 is supplied to the desired portions of the press machine through the distributing valve 59 of the oiling circuit 57.

Figure 6:
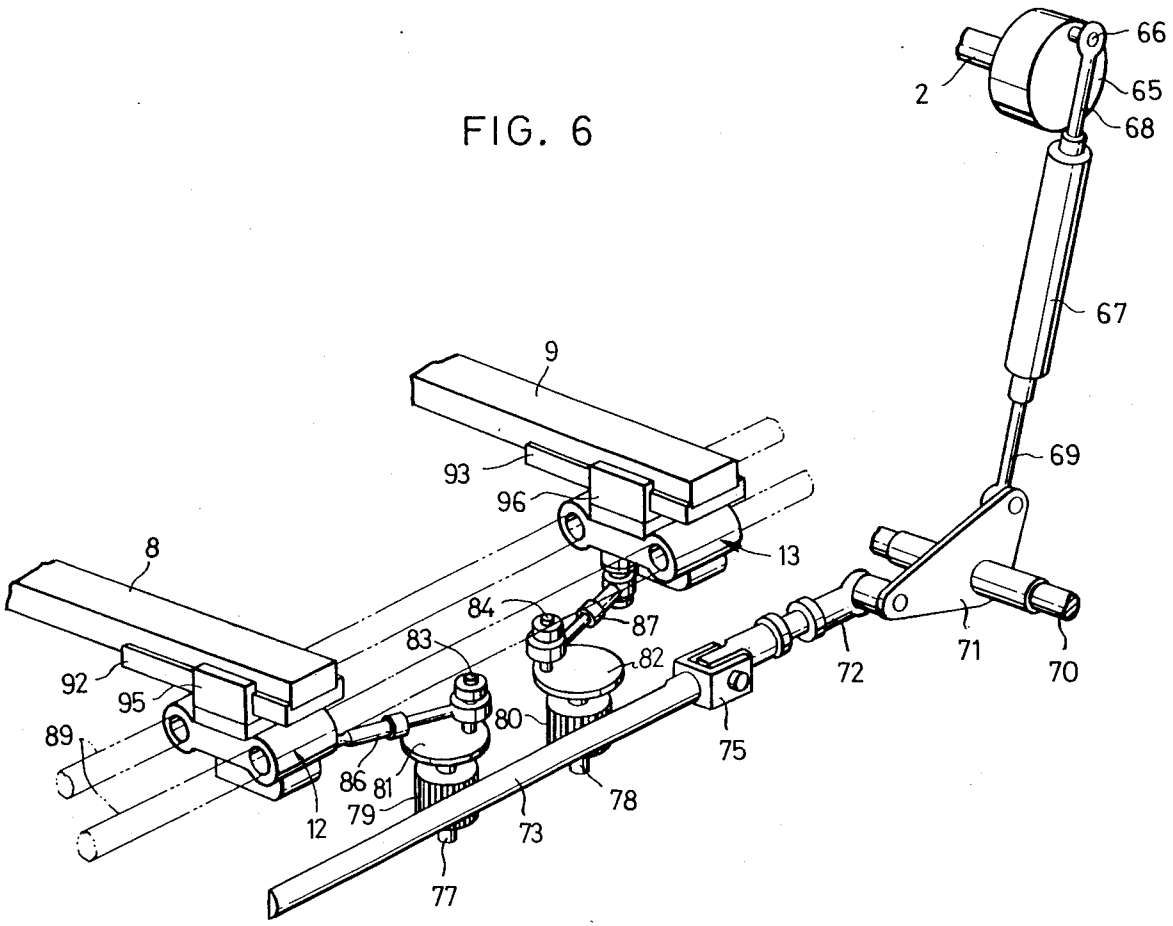
FIG. 6 is a perspective view in explanation of the general arrangements of the clamp-unclamp device.

Description will hereunder be given of the clamp-unclamp device and the lift-lowering device with reference to FIGS. 1, 2 and 6. These driving devices are provided symmetrically at the right and left sides of the press machine and have substantially the same constructions, and hence, the respective devices are explained only on one of the devices. For the purpose of easier understanding, FIG. 6 shows only the construction of the clamp-unclamp device, omitting the lift-lowering device.

In FIG. 6, an eccentric member 65 having an eccentric pin 66 is connected to one end of the crankshaft 2 as being the driving source of the clamp-unclamp device. Connected to the eccentric pin 66 through a piston rod 68 is a cylinder 67 as being a connecting member provided therein with a hydraulic and pneumatic pressure mechanism. A forward end of piston rod 69 connected to the bottom end of this cylinder 67 is pivotally connected to a lever member 71 in the control box 15.

The lever member 71 is rockingly supported on a shaft 70 horizontally racked in the control box 15. Connected to the other end of the lever member 71 is one end of the connecting rod 72, the other end of which is connected to a joint member 75 connected to an end portion of a rack 73. The rack 73 is horizontally held by a holding member, not shown, and linearly, reciprocatingly movable in the longitudinal direction of the press machine, i.e. the directions of approaching to each other and being separated from each other of the feed bars 8 and 9.

The rack 73 is in engagement with two pinions 79 and 80 which have vertical shafts 77 and 78 as the rotary center shafts thereof, and these pinions 79 and 80 are supported by a supporting case, not shown, and rotatable at predetermined positions. Integrally connected to the tops of the pinions 79 and 80 are eccentric members 81 and 82, which are provided thereon with eccentric pins 83 and 84, respectively. The eccentric pins 83 and 84 are connected to the feed bar holding members 12 and 13 through connecting members 86 and 87, respectively. Joint portions at the opposite ends of these connecting members 86 and 87 are universal joints, through which the eccentric pins 83 and 84 are connected to the feed bar holding members 12 and 13, respectively. The feed bar holding members 12 and 13 extend in the directions of approaching to each other and being separated from each other of the feed bars 8 and 9, and include guide members 90 and 91 which are movably supported by two parallel guide rods 89 being supported at opposite ends by bearings 125 and 126 and support blocks 95 and 96 for slidably supporting liners 92 and 93 which are affixed to the undersurface of the feed bars 8 and 9.

In consequence, when the crankshaft 2 rotates, the cylinder 67 moves in the vertical direction due to the eccentric action of the eccentric member 65. This vertical movement causes the rack 73 to make the linear, reciprocating movement through a series of members such as the lever member 71, and this linear, reciprocating movement causes the pinions 79 and 80 to make the rotation, whereby the eccentric members 81 and 82 which are integrally formed on the pinions 79 and 80 are rotated. As a result, the feed bar holding members 12 and 13 are linearly moved along the guide rods 89 by the eccentric action of the eccentric members 81 and 82.

The crankshaft 2 continues to rotate only in one direction, while the lever members 71 and the rack 73 repeat the reciprocatory motions, whereby the pinions 79 and 80 reciprocatingly rotate within a predetermined angular scope. With this arrangement, the feed bar holding members 12 and 13 are alternately subjected to pushing forces and pulling forces from the connecting members 86 and 87 to make the linear reciprocatory motions to operate in association with the slide 4 vertically moving by the rotation of the crankshaft 2, whereby the feed bar holding members 12 and 13 and the feed bars 8 and 9 make the operations of approaching to each other and being separated from each other.

Figure 7:
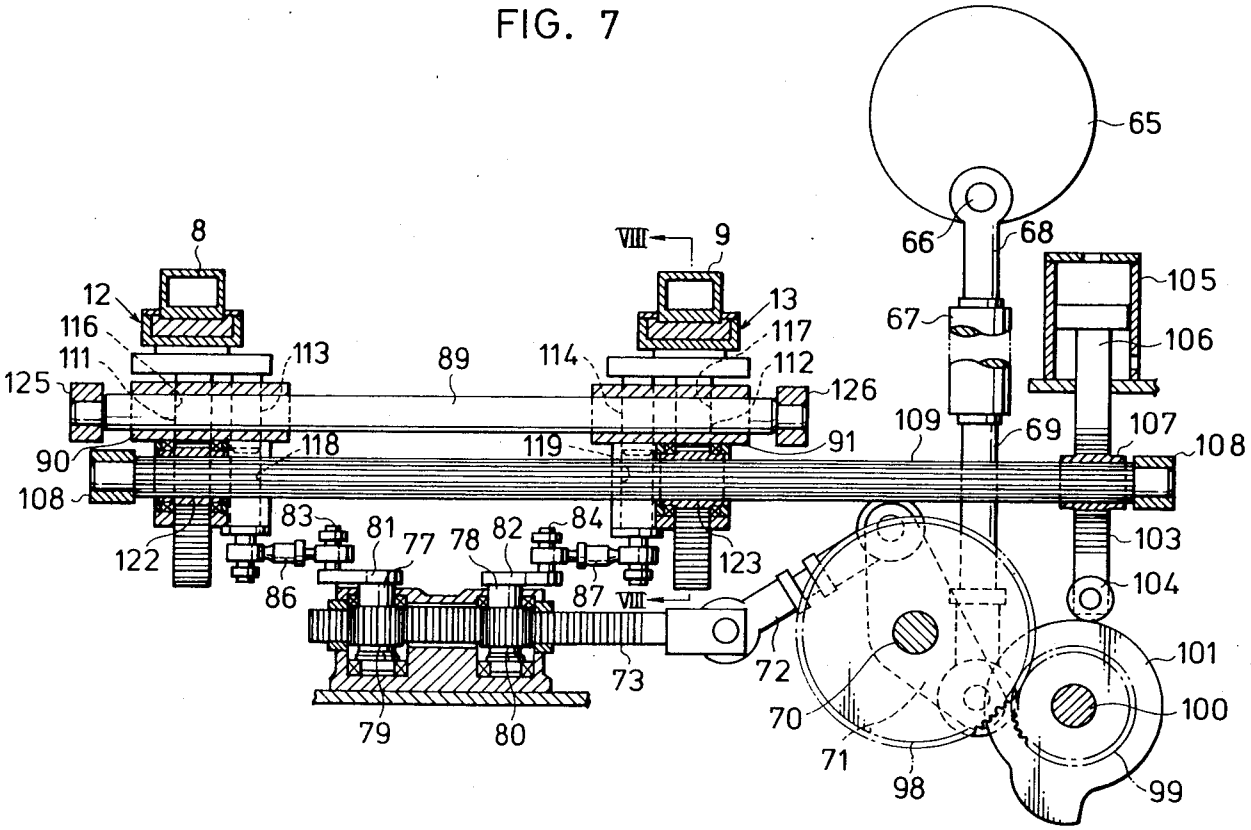
FIG. 7 is a partially sectional view showing the lift-lowering device.
Figure 8:
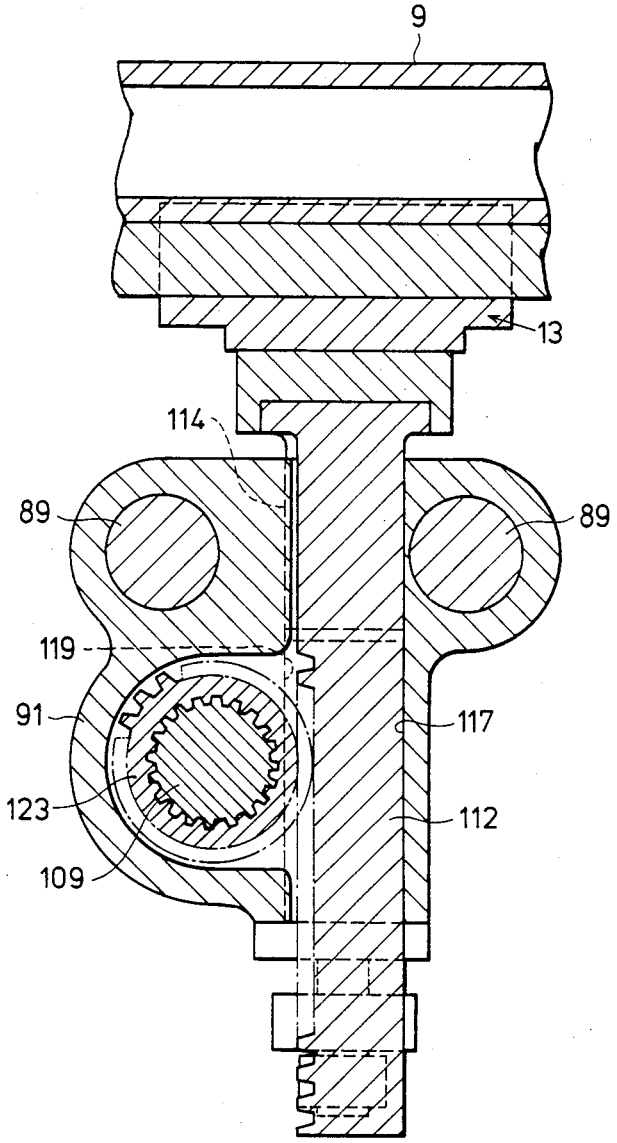
FIG. 8 is a sectional view taken along the line VIII—VIII in FIG. 7.
Figure 9:
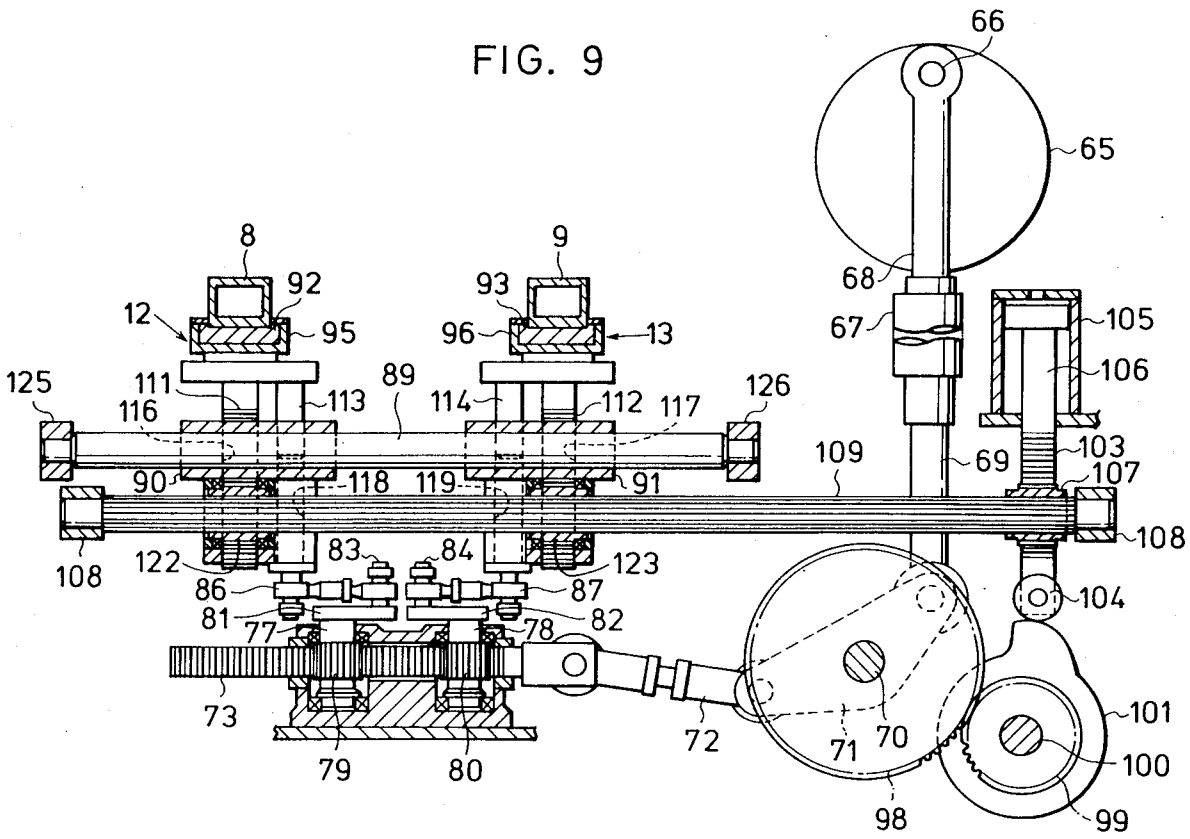
FIG. 9 is a view similar to FIG. 7, showing the state of the lift-lowering device after it is operated from the state shown in FIG. 7.

FIGS. 7 to 9 show the lift-lowering device of the feed bars. Integrally connected to the lever member 71 is a large diameter gear 98. A small diameter gear 99 being in engagement with the large diameter gear 98. A small diameter gear 99 being in engagement with the large diameter gear 98 is rotatable about a horizontal shaft 100, and connected thereto with a cam member 101.

Brought into abutting contact with the cam member 101 is a roller 104 as being a cam follower, which is secured to the forward end of a vertically movable rack 103. The rack 103 is integrally formed on a piston rod 106 of an air cylinder 105. The roller 104 is urged by a pneumatic pressure of the air cylinder 105 to be constantly abutted against the cam 101. A pinion 107 is in engagement with the rack 103. A spline shaft 109 rotatably supported at opposite ends thereof by bearing members 108 and is extended through and engaged with this pinion 107. The axial direction of the spline shaft 109 is horizontal and the length of the spline shaft 109 is as long as the length of directions of approaching to each other and being separated from each other of the feed bars 8 and 9.

The feed bar holding members 12 and 13 are provided at the bottom thereof with racks 111 and 112 and protruding rod members 113 and 114. These racks 111, 112 and the protruding rod members 113 and 114 are vertically, slidably inserted through guide holes 116, 117, 118 and 119 formed in the guide members 90 and 91 which are disposed beneath the feed bar holding members 12 and 13. With this arrangement, the feed bar holding members 12 and 13 are vertically movably supported. Furthermore, the guide holes 118 and 119 are air chambers, and, when the feed bar holding members 12 and 13 are to be moved vertically, air is supplied to the air chambers or discharged therefrom in order to keep a predetermined pressure in the air chambers, so that the weights of the feed bars 8 and 9 can be balancedly supported by the air pressure acting on the protruded rod members 113 and 114 which have the functions of plungers.

Rotatably received in the bottom portions of the guide members 90 and 91 are pinions 122 and 123, and the spline shaft 109 is inserted through and engaged with these pinions 122 and 123. Since the pinions 122 and 123 are spline-coupled to the spline shaft 109, the pinions 122 and 123 rotate integrally with the spline shaft 109 and are slidable on the spline shaft 109.

The cam member 101, the rack 103, the pinion 107, the spline shaft 109, the racks 111 and 112, the pinion 122 and 123, and the like constitute the lift-lowering device of the feed bars 8 and 9.

In consequence, rocking of the lever member 71 causes the spline shaft 109 to be rotated through the cam member 101, the rack 103 and the pinion 107, the rotation of this spline shaft 109 causes the racks 111 and 112 which can be in engagement with the spline shaft 109 downwardly of the feed bar holding members 12 and 13 to move vertically, so that the feed bars 8 and 9 can ascend or descend.

Figure 10:
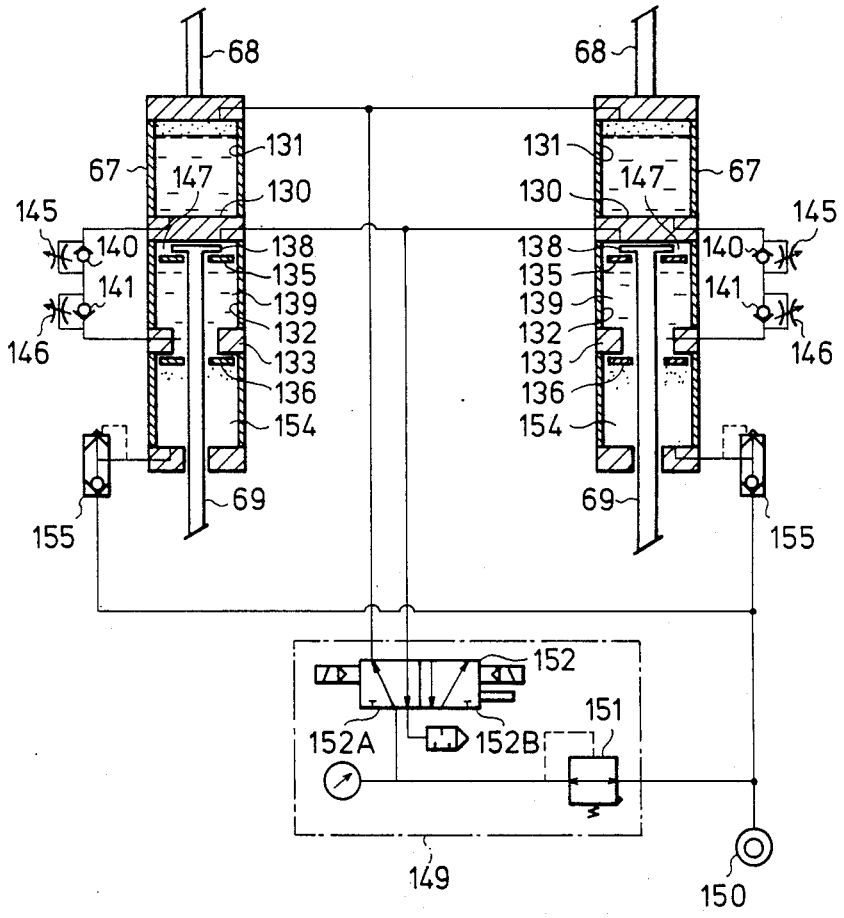
FIG. 10 is a view showing the hydraulic and pneumatic pressure mechanism, which are formed in cylinders, for transmitting an output from the crankshaft.
Figure 10:
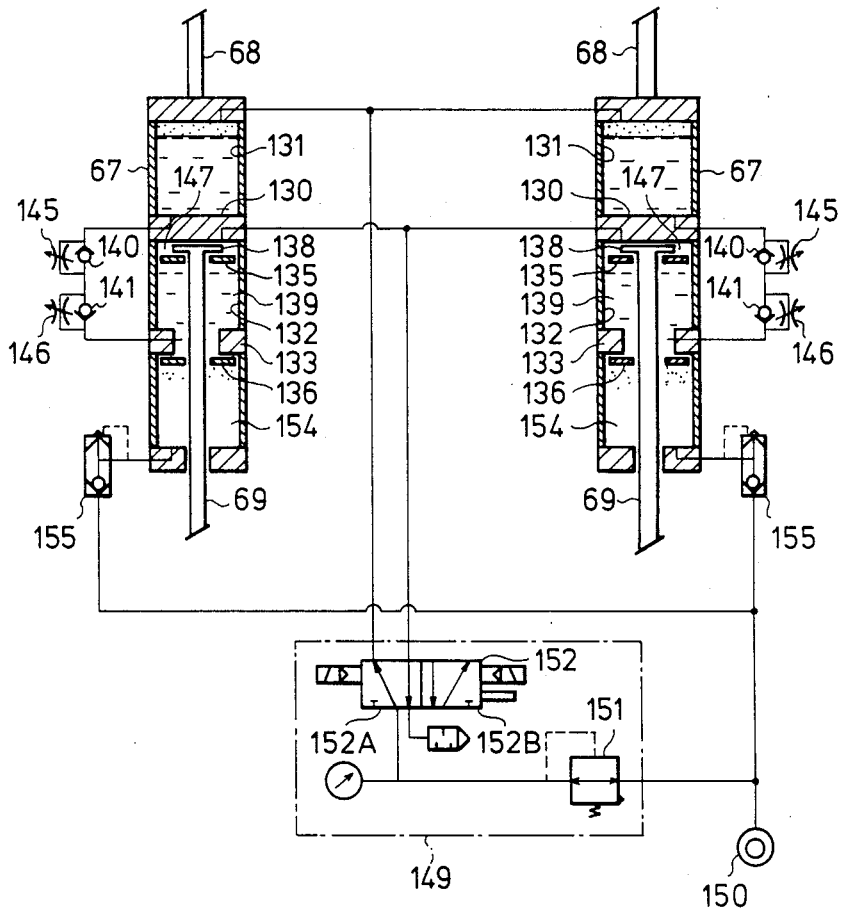
Figure 11:
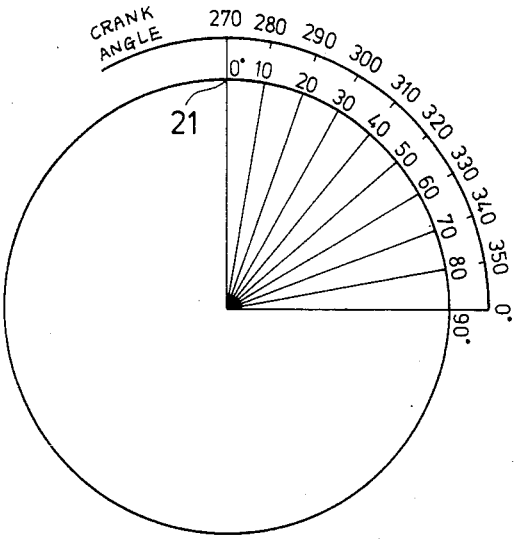
FIGS. 11 to 13 are views showing the characteristics of motions of the eccentric pins in the advance-return device.
Figure 12:
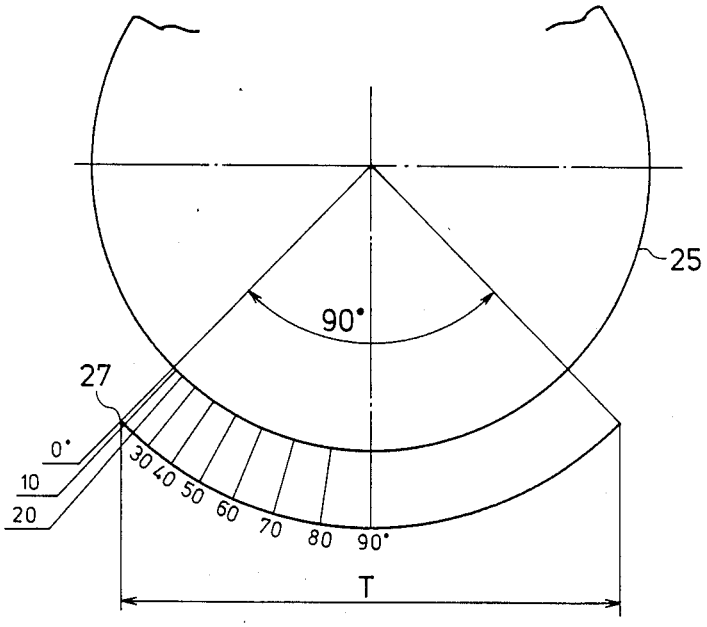

FIG. 10 shows the hydraulic and pressure mechanism, which are provided in the cylinder 67, and control circuits thereof. Referring to this drawing, the interior of the cylinder 67 partitioned by a partition member 130 into two including an oil tank chamber 131 and the piston chamber 132. The oil tank chamber 131 contains therein oil. In the piston chamber 132, a ring shaped stopper wall 133 as being a raised wall is provided at the intermediate portion of the piston chamber 132, a first piston 135 is slidably received between this stopper wall 133 and the partition member 130, and a second piston 136 is slidably received between the stopper wall 133 and the other end of the cylinder 67. The piston rod 69 is slidably inserted through the both pistons 135 and 136. Formed at the top end of the piston rod 69 is a collar 138 engageable with the first piston 135 only when the piston 135 moves upwardly, and the bottom end of the piston rod 69 is connected to one end of the lever member 71.

The oil tank chamber 131 and a chamber 139 confined by the both pistons 135 and 136 are connected to each other through two check valves 140 and 141. Connected in parallel to the check valves 140 and 141, respectively, are a throttle valve 145 for regulating the opening speeds of the feed bars and a throttle valve 146 for regulating the closing speeds of the feed bars. Furthermore, connected to the oil tank chamber 131 and a chamber 147 confined by the first piston 135 and the partition member 130 through a switching device 149 is an air source 150. The switching device 149 includes a relief valve 151 connected to the air source 150 and an electromagnetic type switching valve 152 having circuits 152A and 152B for switching the air of the air source 150 from the oil tank chamber 131 to the chamber 147 and vice versa through this relief valve 151. The air source 150 is interposed between this switching device 149 and a chamber 154 of the cylinder 67 through a rapid air exhaust valve 155. With this arrangement, an original pressure of the air source 150 is constantly applied to the interior of the chamber 154, while, when the air pressure exceeds the original pressure, the rapid air exhaust valve 155 is opened.

Description will hereunder be given of action of this embodiment with reference to FIGS. 11 to 15.

FIGS. 11 to 14 show positions of rotation of the second and the third eccentric pins 27 and 33 corresponding to the every rotations through 10° of the first eccentric pin 21 and a stroke curve of the slider 35 driven by the third eccentric pin 33. In FIG. 5, for example, dimensions for realizing these angular relationships are $R_1$ is 59, $E_1$ is 0, $R_2$ is 75, $R_3$ is 96, $R_4$ is 40, $R_5$ is 60 and $E_2$ is 82 (the unit is mm).

Figure 13:
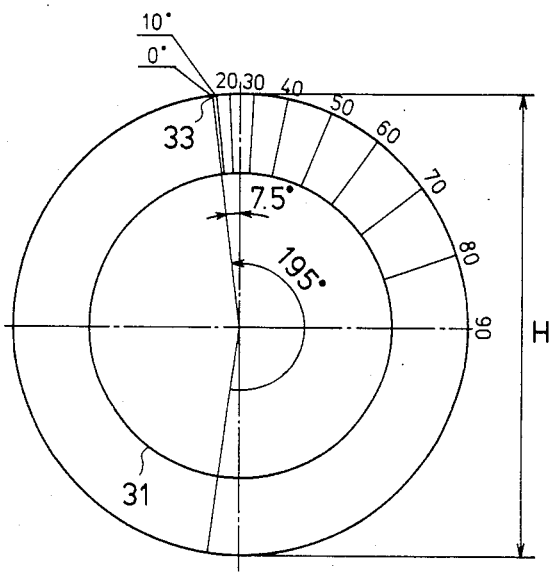
Figure 14:
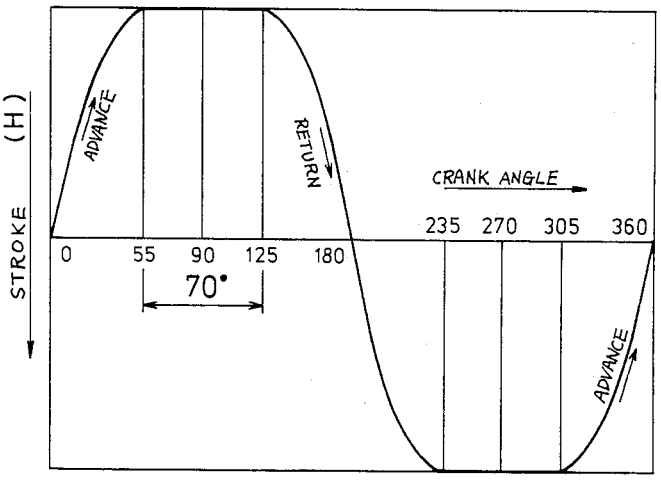
FIG. 14 is a view showing the stroke curve of the slider.

In FIG. 13, at angles 7.5° to the left and the right of a vertical line passing through the center, as shown at angles 35° to the left and the right of the crank angles 90° and 270° on the stroke curve shown in FIG. 14, the slider 35 makes very small bobbing motions in the direction of the stroke, but, is substantially stopped, whereby the proper conditions are shown as the advance-return motions of the feed bars 8 and 9. Additionally, as methods of changing the stop angles of the feed bars 8 and 9 in the feeding direction include (1) when the value of eccentricity of the first eccentric pin 21 is changed, the stop angles and the value of the bobbing motions are changed substantially in proportion thereto, (2) when $R_2$ of the first pinion 25 in changed, the stopped angles and the value of the bobbing motions are changed substantially in inverse proportion thereto, (3) when $R_4$ of the second pinion 31 is changed, the stopped angles and the value of the bobbing motions are changed substantially in inverse proportion thereto, and (4) when the value of eccentricity of the first eccentric pin 21 is changed, and simultaneously, $R_2$ is changed in such a manner that the angle of rotation of the first pinion 25 is not varied, the stop angles are changed substantially in proportion to the value of eccentricity of the eccentric pin 21, however, the value of the bobbing motions is not varied. An adequate method is selected in accordance with the circumstances.

As apparent from the positional relationships between the first and the third eccentric pins 21 and 33, in the vicinity of the stop angle of the slider 35, the change in speed of the slider 35 in the direction of stroke becomes very small and the impact is low, thus enabling to cope with the speeding up of the press.

Figure 15:
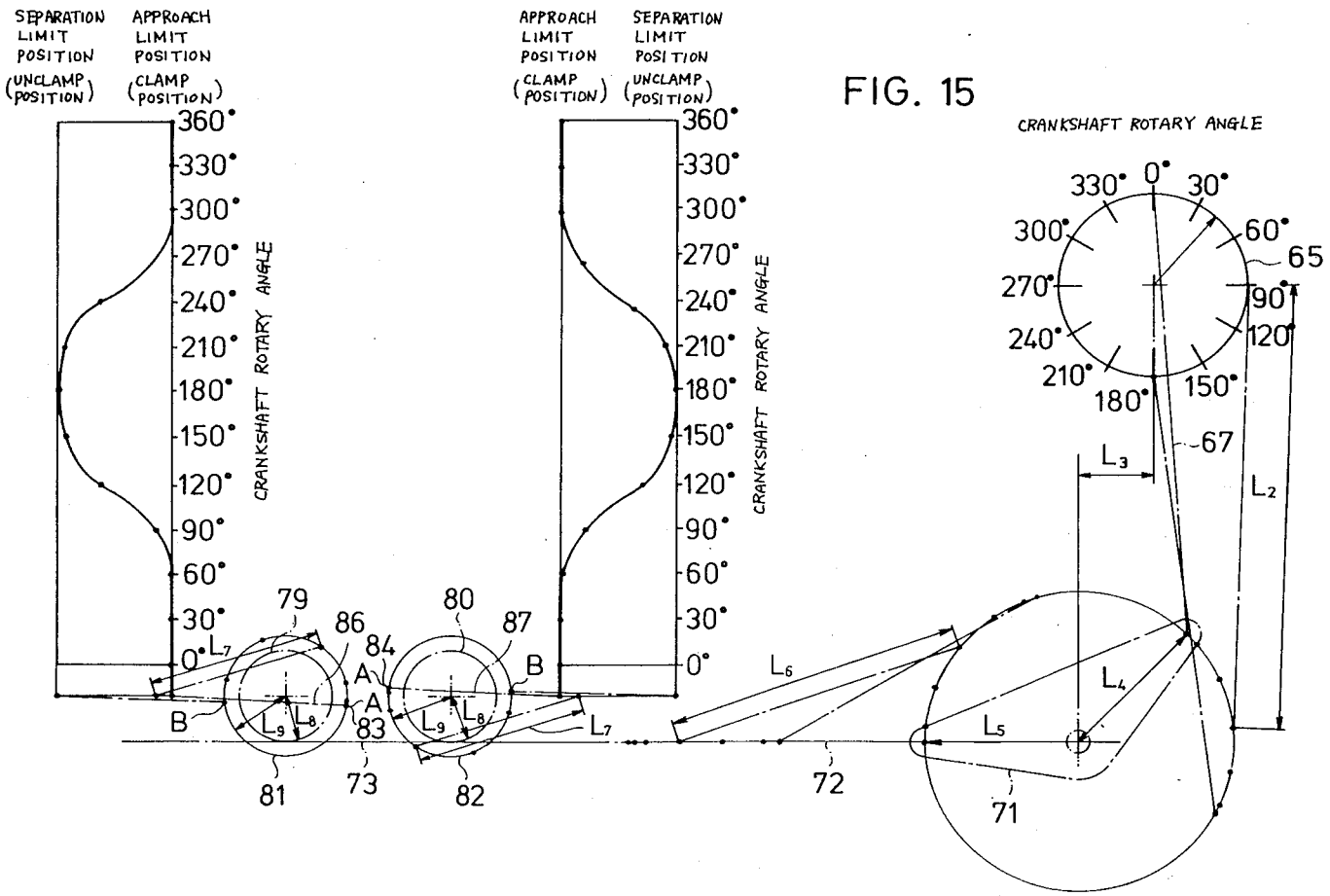
FIG. 15 is a view showing the principle of the operation of the clamp-unclamp device.

FIG. 15 shows the characteristics of motions of the various portions of the clamp-unclamp device. The rotation of the eccentric member 65 causes the lever member 71 to rock, the linear reciprocatory movement of the rack 73 causes the pinions 79 and 80 to rotate reciprocatingly, while the pinions 79 and 80 rotate substantially within the scope of 180° as indicated by positions A and B of the eccentric pins 83 and 84. These reciprocatory rotations are realized by adequately setting the lever ratio of the lever member 71 and the diameters of the pinions 79 and 80. In assembling the pinions 79, 80 and the like to build up this device, the eccentric pins 83 and 84 of the two eccentric members 81 and 82 are disposed at positions in symmetry with respect to a point relative to the rotary center of the pinions 79 and 80, respectively. With this arrangement, when the pinions 79 and 80 are rotated by the rack 73, the eccentric pins 83 and 84 draw circularly arcuate loci while constantly maintaining the positional relationship of the symmetry with respect to a point. As a result, the two feed bar holding members 12 and 13 can be moved in a symmetrical relation, so that the feed bar holding members 12, 13 and the feed bars 8, 9 can perform the motions of approaching to each other and being separated from each other.

When the settings are made such that, when the crankshaft rotary angles are 0° and 180°, the feed bar holding members 12 and 13 reach the approach limit position and the separation limit position, respectively, and, when the crankshaft rotary angles are 0° and 180°, the eccentric pins 83 and 84 reach the positions A and B, where the eccentric pins 83 and 84 substantially meet the diameters of the pinions 79 and 80 which are in parallel to the direction of the linear movement of the rack 73, the feed bar holding members 12 and 13 moved by the components in the directions of approaching to each other and being separated from each other of the feed bar holding members 12 and 13 out of the circularly arcuate loci of the eccentric pins 83 and 84, the moving speeds of the feed bar holding members 12 and 13 become the highest at the intermediate portion between the approach limit position and the separation limit position, these speeds are lowered in the vicinity of these limit positions, and thereafter, the speeds continue to decrease and reach zero at the approach limit and the separation limit positions.

In consequence, the inversions in the moving directions of the feed bar holding members 12 and 13 at the approach limit and the separation limit positions can be smoothly performed and the work clamp operations by the fingers 8A and 9A at the approach limit position as being the work clamp position can be made smoothly and reliably.

As indicated by curves in FIG. 15, in this press machine, the feed bars 8 and 9 are operated to make the dwells for a predetermined period of time substantially at the approach limit and the separation limit positions, so that, due to these dwell times, when the feed bars 8 and 9 reach substantially the approach limit position and clamp the work by the fingers 8A and 9A, the feed bars 8 and 9 can make the aforesaid advance motions and, when the feed bars 8 and 9 reach substantially the separation limit position and unclamp the work, the feed bars 8 and 9 can make the aforesaid the return motions.

In order to cause the feed bars 8 and 9 to perform the operations similar to the curves in the graphic chart of FIG. 15, it is preferable to set the various values such that, for example, the radius of eccentricity $L_1$ of the eccentric member 65 is 61.5 mm, the total length $L_2$ of the cylinder 67, the piston rods 68 and 69 is 1696 mm, the distance $L_3$ between the centers of the eccentric member 65 and the lever member 71 is 90 mm, the length $L_4$ of one of the arms of the lever member 71 is 100 mm, the length $L_5$ of the other of the arms of the lever member 71 is 100 mm, the length $L_6$ of the connecting rod 72 is 200 mm, the length $L_7$ of the connecting members 86 and 87 is 115 mm, the radius $L_8$ of the pinions 79 and 80 is 30 mm and the radius of eccentricity $L_9$ of the eccentric members 81 and 82 is 40 mm. This is an ideal embodiment, and the present invention need not necessarily be limited to these dimensions.

Description will hereunder be given of action of the hydraulic and the pneumatic mechanisms.

(A) As shown in FIG. 10, when the press machine is automatically operated, if the electromagnetic type switching valve 152 connected to the hydraulic and pneumatic mechanism is switched to one 152A of the circuits, then the air is supplied into the oil tank chamber 131, while the chamber 147 is opened to atmosphere. The oil in the oil tank chamber 131 under the pneumatic pressure supplied into the oil tank chamber 131 passes through the check valve 140 and the throttle valve 146 and flows into the chamber 139, to thereby raise the first piston 135. As the first piston 135 is raised, the piston rod 69 engaged through the collar 138 with the first piston 135 is also raised.

In the state where the piston rod 69 is raised to the partition member 130, the piston rod 69 and the cylinder 67 come to be integrally connected to each other, whereby the rotation of the crankshaft 2 is transmitted to the lever member 71, with the result that the feed bars 8 and 9 are opened or closed in synchronism with the rotations of the crankshaft 2.

(B) To openably operate the feed bars 8 and 9 in the manual operation, the electromagnetic type switching valve 152 is switched to the other 152B of the circuits. Then, the air is supplied to the chamber 147, while the oil tank chamber 131 is opened to atmosphere. Under the pneumatic pressure supplied into the chamber 147, the first piston 135 and the piston rod 69 are lowered, while the oil in the chamber 139 passes through the check valve 141 and the throttle valve 145 and is recirculated into the oil tank chamber 131. In consequence, as the piston rod 69 is lowered, the feed bars 8 and 9 are openably operated through the rocking of the lever member 71.

At this time, the flowrate of the oil recirculated into the oil tank chamber 131 from the chamber 139 is regulated by the throttle valve 145, whereby the lowering speed of the piston rod 69, i.e. the opening speeds of the feed bars 8 and 9 can be accurately brought into unison at opposite sides.

Furthermore, to closably operate the feed bars 8 and 9 in the manual operation, the electromagnetic type switching valve 152 is switched to one 152A of the circuits. Then, the air is supplied into the oil tank chamber 131, while the chamber 147 is opened to atmosphere. Under the pneumatic pressure supplied into the oil tank chamber 131, the oil in the oil tank chamber 131 passes through the check valve 140 and the throttle valve 146 and flows into the chamber 139, to thereby raise the first piston 135. As the first piston 135 is raised, the piston rod 69 engaged therewith through the collar 138 is also raised. In consequence, as the piston rod 69 is raised, the feed bars 8 and 9 are closably operated through the rocking of the lever member 71.

At this time, the flowrate of the oil supplied from the oil tank chamber 131 into the chamber 139 is regulated by the throttle valve 146, whereby the rising speed of the piston rod 69, i.e. the closing speeds of the feed bars 8 and 9 can be accurately brought into unison at opposite sides.

In the state where the first piston 135 is disposed at a manual unclamp position, i.e. the lowered position, if the press machine is driven, then, as the crankshaft 2 rotates, the cylinder 67 vertically moves relative to the piston rod 69 with the first piston 135 being left at the manual clamp position, so that the press machine can be operated as in the manual clamp operation.

Moreover, during the closing operations of the feed bars 8 and 9, if the pressure in the chamber 139 is raised due to some abnormality or other, then the raised pressure in the chamber 139 acts on the second piston 136, to thereby raise the pressure in the chamber 154. When the pressure in the chamber 154 exceeds the original pressure of the air source 150, the rapid air exhaust valve 155 is instantaneously operated, to thereby discharge the air in the chamber 154 to atmosphere. As a result, the second piston 136 is lowered and the volume of the chamber 139 is increased, to thereby prevent an excessive load in the chamber 139.

This embodiment with the above-described arrangement can offer the following advantages.

More specifically, the stop angle of the slider at the end of the advance-return motions can be very easily adjusted, the impact is low, the motions are sped up, the operation of the press is sped up, and the speeding up of the press operation can be dealt with easily.

In the clamp-unclamp device, spaces are formed between the members, and the portions where the diving force is transmitted through the contact between the members are limited to the engagements between the rack 73 and the pinions 79 and 80, whereby, as compared with the conventional device, the number of the portions where the driving force is transmitted through the contact between the members is decreased, the transmission of the driving force is sped up, so that the operating efficiency of the device as a whole is raised, thus enabling to obviate the adverse influence of the backlashes as seen in the conventional device.

The two pinions 79 and 80 for driving the feed bar holding members 12 and 13 are brought into engagement with one rack 73, whereby the driving force can be simultaneously transmitted to the two feed bar holding members 12 and 13, so that this device can be improved in the operating efficiency from this point too.

The driving force for raising and lowering the feed bars 8 and 9 is transmitted from the crankshaft 2 for vertically moving the slide 4 through the driving force transmitting means such as the cylinder 67, so that the feed bars 8 and 9 can be raised or lowered reliably in unison with the press process accompanied by the vertical movements of the slide 4. The operations of approaching to each other, being separated from each other, being raised and being lowered of the feed bars 8 and 9 are performed by the rocking of the lever member 71, whereby these motions of approaching to each other, being separated from each other, being raised and being lowered can be performed at predetermined timings, so that, when it becomes necessary to change these timings, it can be dealt with easily.

The lift-lowering device has a simplified construction including a small number of parts such as the cam member 101, the first rack 103, the spline shaft 109 and the like, and the dimensions of the device in a direction perpendicular to the paper surfaces of FIGS. 7 and 9 are small, so that the device can be rendered compact in size. Particularly, the spline shaft 109 having the largest dimensions extends along the rack and the guide rods 89 constituting the clamp-unclamp device, necessity of securing a special space for the spline shaft 109 is eliminated, so that the device can be successfully rendered compact in size from this respect too. Further, the rack 73, the pinion 79 and 80 are assembled downwardly of the spline shaft 109, and the guide rods 89 and the like are disposed upwardly of the spline shaft 109, whereby the spaces are effectively utilized to dispose the respective members reasonably while the operations of the respective members are being secured.

There is not provided an air circuit or the like which would otherwise cause a time lag in transmitting a driving force in the route of transmitting the driving force for raising or lowering the feed bars 8 and 9, whereby the driving force can be rapidly transmitted to the feed bars 8 and 9, so that the press operation can be sped up, to thereby make the rise and fall of the feed bars 8 and 9 reliably follow the press process carried out by the vertical movement of the slide 4.

In the hydraulic and pneumatic pressure mechanism, the fluid capable of moving the first piston 135 is the oil and the fluid capable of switching the first piston 135 is the air, whereby the moving speed of the piston 135 can be accurately controlled by the throttle valves 145 and 146, so that the opening and the closing operations of the feed bars 8 and 9 at the opposite sides can be accurately brought into unison.

The first piston 135 and the piston rod 69 are separated from each other, whereby, in the state where the first piston 135 is in the manual unclamp position, if the press machine is operated, then the cylinder 67 vertically moves relative to the piston rod 69 with the first piston 135 being left at the manual unclamp position, so that the press machine can be operated in the manual unclamp conditions.

Even when an abnormality occurs during closing operations of the feed bars 8 and 9 and the pressure in the chamber 139 is raised, if the raised pressure in the chamber 139 acts on the piston 136 and the pressure in the chamber 154 exceeds the original pressure of the air source 150, then the rapid air exhaust valve 155 is instantaneously operated to discharge the air in the chamber 154 to atmosphere, so that the volume of the chamber 139 is increased to thereby prevent the excessive load in the chamber 139.

Furthermore, in this embodiment, such an arrangement is adopted that the oil tank 50 is formed in the control box 16 and the oil 51 filled in the oil tank 50 can be delivered to the required various portions through the piston 55 by use of the rising and lowering motions of the rack 23, whereby necessity of providing a special oil tank is eliminated, so that the construction can be simplified. Moreover, the provision of the bypass circuit 60 makes it possible to relieve the oil pressure when some abnormality occurs in the oiling circuit 57, thus enabling to prevent various portions from being damaged.

Figure 17:
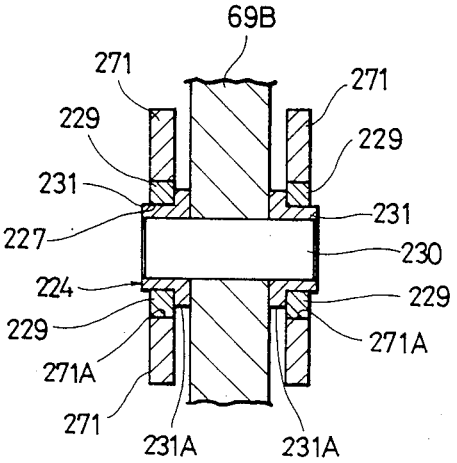
FIG. 17 is a sectional view taken along the line XVII—XVII in FIG. 16.
Figure 16:
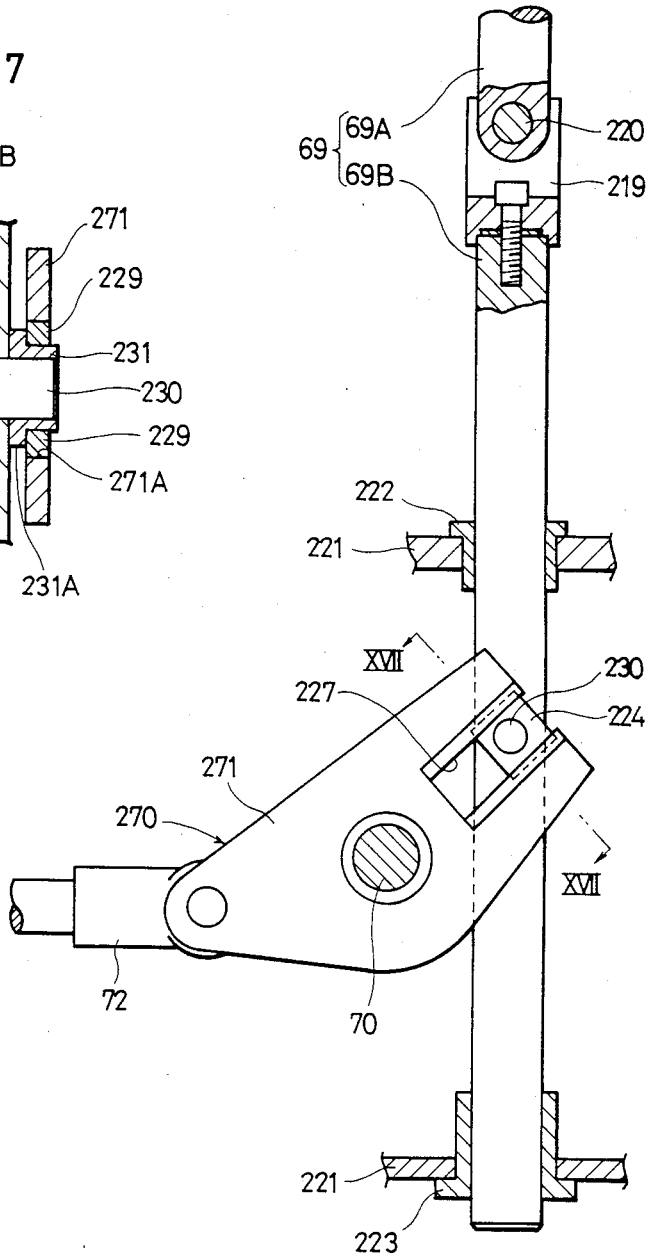
FIG. 16 is a front view, partially cutaway, showing a modification of a connecting portion between the piston rod and the lever member.

In the above embodiment, an example, wherein the piston rod 69 and the lever 71 are pivotally connected to each other, has been illustrated, however, the present invention need not necessarily be limited to this, and such a connecting construction as shown in FIGS. 16 and 17 may be adopted.

The modification shown in FIGS. 16 and 17 is constructed such that the feed bars are separated rapidly from each other relative to the lowering of the slide and the feed bars slowly approach to each other relative to the rising of the slide, so that, even if a large top force is used, interference of the feed bars with the top force can be avoided.

In this modification, the piston rod 69 shown in the preceding embodiment is formed into a divided in two-type which includes a first piston rod 69A and a second piston rod 69B. The first and the second piston rods 69A and 69B are relatively rotatably connected to each other through a joint member 219 and a pin 220. The second piston rod 69B is slidably inserted through tubular guide members 222 and 223, which are fixed to frames 221 provided in control boxes 15 and 16, respectively. The second piston rod 69B can be linearly reciprocated only in the vertical direction. Secured to the second piston rod 69B is a movable member 224, which is slidably coupled into a guide groove 227 of a lever member 270. The movable member 224 is a runner movable relative to the lever member 270.

The lever member 270 is constituted by two plates 271 being in parallel to each other. These plates 271 are each formed with a groove 271A for providing the guide groove 227. Mounted to the top and the bottom inner surfaces of the groove 271A are slide members 229 for securing satisfactory sliding of the movable member 224. The movable member 224 is constituted by square plate shaped blocks 231 rotatably mounted to opposite end portions of a pin 230. Each of the blocks 231 is slidably provided between the slide members 229, and locked against dislodging in the axial direction of the pin 230 by a protruded portion 231A.

Figure 18:
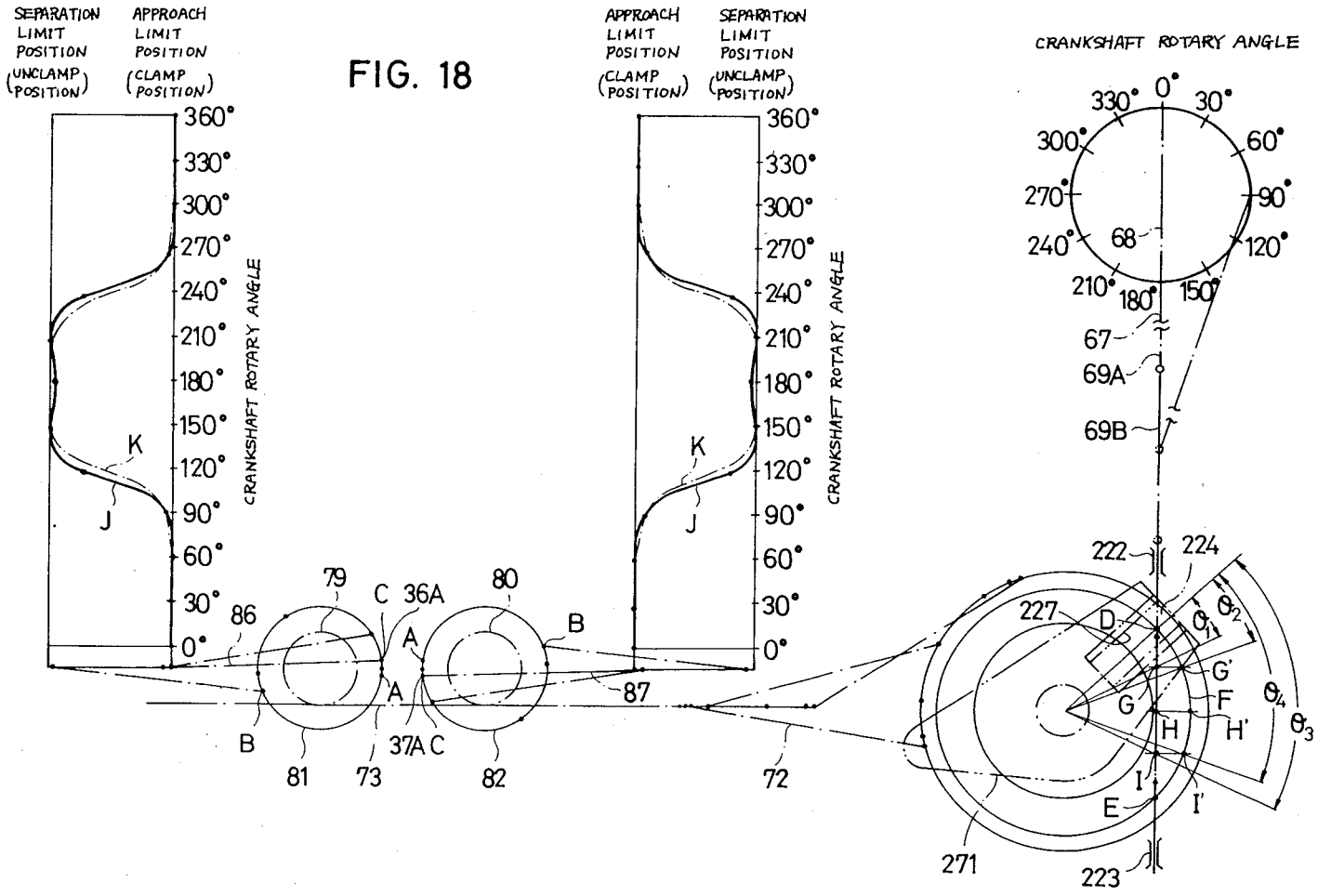
FIG. 18 is a view showing the principle of the operation in the modification.

Description will hereunder be given of action and effects, when the above-described connecting construction is adopted, with reference to FIG. 18 as well.

FIG. 18 is a view showing the principle similar to FIG. 15, indicating moving paths of the feed bars 8 and 9 upon completion of one driving cycle by one turn of the crankshaft 2. At this time, the lever member 270 is reciprocatingly rocking. In the preceding embodiment, when the crankshaft 2 rotates through 360°, the eccentric pins 83 and 84 of the eccentric members 81 and 82 reciprocatorily rotate within the scope from a position A to a position B. However, in this modification, due to the initial posture of the lever member 270, the eccentric pins 83 and 84 reversely rotate from a position C to the position A, thereafter, reach the position B, then, return from the position B to the position A, and thereafter, return to the position C.

When the crankshaft 2 rotates through 360°, the movable member 224 makes a movement relative to the lever member 270 by the groove 227, whereby the movable member 224 makes a linear reciprocating movement within the scope from a position D to a position E. As in this modification, when the connection between the piston rod 69 and the lever member 270 is adopted, a difference in the angle of rocking of the lever member 270 relative to the angle of rotation of the crankshaft 2 from the preceding embodiment occurs.

To explain this more specifically, in the case of the preceding embodiment, the connecting end portion of the piston rod 69 on the side of the lever member 71 reciprocatingly moves along a circularly arcuate moving path F connecting the position D to the position E, the radius of the eccentric member 65 and the length of the lever member 71 are satisfactorily small as compared with a distance between the eccentric member 65 and the lever member 71, and a length component of the piston rod 69 in the lateral direction in FIG. 18 is negligible. In consequence, when the crankshaft is rotated through the same angle as before, the movable member 224 in this modification and the connecting end portion of the piston rod 69 on the side of the lever member are deemed to be substantially at the same horizontal height positions. In short, in the case where the angle of rotation of the crankshaft is 60° (since the lever member is reciprocatingly rocked by one turn of the crankshaft, there may be a case where the angle of rotation is 300°), the movable member 224 is located at a position G and the connecting end portion on the side of the lever member in the preceding embodiment is located at a position G', respectively. Similarly to the above, in the case where the angle of rotation of the crankshaft is 90° there may be a case where the angle of rotation is 270°), the movable member 224 is located at a position H and the connecting end portion on the side of the lever member in the preceding embodiment is located at a position H'. In the case where the angle of rotation is 120° (There may be a case where the angle of rotation is 240°), the movable member 224 is located at a position I and the connecting end portion on the side of the lever member in the preceding embodiment is located at a position I'.

Because of this, when consideration is given only to one-way rocking of the lever member, then, when the angles of rotation of the crankshaft are 0°, 90° and 180°, the angles of rocking of the lever member in this modification and the preceding embodiment are equal to each other. However, when the angle of rotation of the crankshaft is 60°, the angle of rocking in this modification becomes $\theta_1$ and the angle of rocking in the preceding embodiment becomes $\theta_2$. Furthermore, when the angle of rotation of the crankshaft is 120°, the angle of rocking in of modification becomes $\theta_3$ and the angle of rocking in the preceding embodiment becomes $\theta_4$.

In consequence, when the angle of rotation of the crankshaft is within the range from 0° to less than 90°, the angle of rocking of the lever member 270 in this modification is smaller than that in the preceding embodiment, whereby the rocking movement of the lever member 270 becomes lagged, while within the range from 90° to less than 180° C., the angle of rocking in this modification is larger than that in the preceding embodiment, whereby the rocking movement of the lever member 270 becomes advanced.

Solid lines J in FIG. 18 show the moving paths of the feed bars 8 and 9 for approaching to each other and being separated from each other when the lever member 270 is rocked under the above-described characteristics relative to the rotation of the crankshaft 2. In contrast thereto, one-dot chain lines K indicate the moving paths of the feed bars for approaching to each other and being separated from each other in the preceding embodiment. As shown in this graphic chart, the range of the angle of rotation of the crankshaft 2, which is necessary for moving the feed bars 8 and 9 from an approach limit position to a separation limit position in this modification, is smaller than that in the preceding embodiment. In consequence, the approaching and separating operations of the feed bars 8 and 9 are sped up. The range of the angle of rotation of the crankshaft 2 when the feed bars 8 and 9 reach the approach limit position or a position close thereto, or the separation limit position or a position close thereto becomes larger than that in the preceding embodiment. Because of this, in this modification, the dwell times of the feed bars 8 and 9 at these positions are secured to be long, and the time durations for allowing the feed bars 8 and 9 to advance and return, and further, ascend and descend can be made longer than those in the preceding embodiment.

Particularly, the feed bars 8 and 9 rapidly return to the separation limit position and remain at the separation limit position till late, so that an advantage can be offered in relation with the top force 5. Namely, the top force 5 is replaced by any one of various size, and particularly, when the top force 5 is replaced by one which is large in size in the vertical direction and the slide 4 is lowered, the feed bars 8 and 9 are rapidly separated from each other, and, when the slide 4 is raised, the feed bars 8 and 9 are lagged in approach, whereby no interference occurs between the feed bars 8, 9 and the top force 5, so that a wide adaptability for the various top forces can be obtained.

What is claimed is:

1. A feed bar driving system in a transfer press machine, wherein two feed bars being in parallel to each other are driven, a work carried in by said feed bars is formed into a predetermined shape and carried out, comprising:

an advance-return device for reciprocating said feed bars each having a work clamping finger, for a predetermined distance; and a clamp-unclamp device for approaching said feed bars to each other or separating said feed bars from each other so that said fingers can clamp or unclamp said work, said clamp-unclamp device including an eccentric member affixed to a crankshaft rotatable in synchronism with the vertical movement of a slide, connecting means, one end of which is connected to said eccentric member, a lever member connected to the other end of said connecting means, a rack connected to said lever member and linearly, reciprocatingly movably supported, two pinions in engagement with said rack, and feed bar holding members connected to eccentric members affixed to said pinions, said feed bars movable in a direction of approaching to each other or being separated from each other by the rotation of said eccentric members.

2. A feed bar driving system as set forth in claim 1, wherein said connecting means is a cylinder.

3. A feed bar driving system as set forth in claim 1, wherein: said connecting means comprises a cylinder; a piston is slidably received in said cylinder; a piston rod provided at one end thereof with a collar engageable with said piston only when said piston is moved to one side and connected at the other end thereof to said lever member is slidably inserted through a space formed between said piston and the other end of said cylinder; one of chambers partitioned by said piston is communicated with an oil tank through two throttle valves including a throttle valve for regulating the opening speeds of the feed bars and a throttle valve for regulating the closing speeds of the feed bars; while, an air source is connected to said oil tank and the other of the chambers through a switching valve.

4. A feed bar driving system as set forth in claim 3, wherein said tank is provided in said cylinder.

5. A feed bar driving system as set forth in claim 3, wherein: a raised wall is provided in the other of the chambers; the other piston is slidably received between said raised wall and the other end of said cylinder; and said air source is connected to a chamber defined by the other piston and the other end of said cylinder through a rapid air exhaust valve.

6. A feed bar driving system as set forth in claim 1, wherein said advance-return device comprises:

a rack connected to a crankshaft through an eccentric member;

a pinion in engagement with said rack to be rotated;

a first eccentric pin affixed to said pinion;

a pinion engagement with a rack connected to said eccentric pin, rotatable by the reciprocatory motions of said rack and having a second eccentric pin; and a slider linearly movable in the longitudinal direction of said feed bars by the rotary movement of a lever connected to a rotary shaft of said pinion.

7. A feed bar driving system as set forth in claim 6, wherein said slider is formed with a groove in a direction perpendicularly intersecting the moving direction thereof, and a runner movable in said groove is loosely coupled in said groove on the side of the forward end of said lever.

8. A feed bar driving system as set forth in claim 1, wherein there is provided means for supplying oil to predetermined various portions of the press machine by the vertical movement of a rack for driving said advance-return device.

9. A feed bar driving system as set forth in claim 8, wherein said means for supplying oil includes:

a piston formed at the bottom end of said rack;

a cylinder, into which said piston is inserted; and an oiling circuit connected to a discharge port of said cylinder.

10. A feed bar driving system in a transfer press machine, wherein two feed bars being in parallel to each other are driven, a work carried in by said feed bars is formed into a predetermined shape and carried out, comprising:

(a) an advance-return device for reciprocating said feed bars each having a work clamping finger, for a predetermined distance;

(b) a clamp-unclamp device for approaching said feed bars to each other or separating said feed bars from each other so that said fingers can clamp or unclamp said work, said clamp-unclamp device including a cylinder connected through an eccentric member to one end of a crankshaft for driving a slide, a rack linearly movable through a lever rockingly connected to said cylinder, and two pinions rotatable in engagement with said rack, for driving said feed bar holding members in directions of approaching to each other and being separated from each other; and (c) a lift-lowering device for raising or lowering said feed bars, said lift-lowering device including a rack for raising or lowering said feed bars by the rotation of a spline shaft extending in the directions of approaching said feed bars to each other and separating said feed bars from each other.

11. A feed bar driving system as set forth in claim 10, wherein said rack is in engagement with pinions incorporated in said feed bar holding members, respectively, and said pinions are engaged with said spline shaft.

12. A feed bar driving system as set forth in claim 10, wherein said spline shaft is rotated by the same driving source as that for said clamp-unclamp device.

13. A feed bar driving system as set forth in claim 10, wherein said means for driving said spline shaft includes:

a gear affixed to a support shaft of said lever;

a gear in engagement with said gear;

a cam affixed to a support shaft of said latter gear;

a rack in contact with said cam and vertically movable by the rotation of said cam; and a pinion affixed to said spline shaft, being in engagement with said rack and rotated by the vertical movement of said rack.

14. A feed bar driving system as set forth in claim 13, wherein said rack is in abutting contact with said cam through a cam follower and constantly urged in the abutting direction.

15. A feed bar driving system as set forth in claim 14, wherein said cam follower is urged through a cylinder.

16. A feed bar driving system as set forth in claim 10, wherein said feed bar holding members are given a rising force by air.

* * * * *